US006678984B1

(12) United States Patent
Rapp et al.

(10) Patent No.: US 6,678,984 B1
(45) Date of Patent: Jan. 20, 2004

(54) WEAPON SAFEGUARDING SYSTEM AND PROCESS

(75) Inventors: Bernhard Rapp, Dachau (DE); Wolfgang Richter, Germering-Harthaus (DE)

(73) Assignee: R2 AG, Dachau (DE)

( * ) Notice: Subject to any disclaimer, the term of this patent is extended or adjusted under 35 U.S.C. 154(b) by 0 days.

(21) Appl. No.: 09/657,899

(22) Filed: Sep. 8, 2000

(30) Foreign Application Priority Data

Jul. 31, 2000 (DE) ..... 100 37 227

(51) Int. Cl.[7] ..... F41A 17/06
(52) U.S. Cl. ..... 42/70.11; 42/70.01
(58) Field of Search ..... 42/70.01, 70.11

(56) References Cited

U.S. PATENT DOCUMENTS

| | | | | |
|---|---|---|---|---|
| 5,172,967 | A | | 12/1992 | Pipe |
| 5,204,672 | A | | 4/1993 | Brooks |
| 5,359,322 | A | | 10/1994 | Murray |
| 5,461,812 | A | * | 10/1995 | Bennett |
| 5,603,179 | A | * | 2/1997 | Adams |
| 5,811,897 | A | | 9/1998 | Spaude et al. |
| 5,937,557 | A | | 8/1999 | Bowker et al. |
| 6,185,852 | B1 | * | 2/2001 | Whalen et al. |
| 6,237,271 | B1 | * | 5/2001 | Kaminski |
| 6,260,300 | B1 | * | 7/2001 | Klebes |
| 6,293,039 | B1 | | 9/2001 | Fuchs |
| 6,301,815 | B1 | * | 10/2001 | Sliwa |
| 6,343,140 | B1 | * | 1/2002 | Brooks |
| 6,363,647 | B2 | * | 4/2002 | Kaminski |

FOREIGN PATENT DOCUMENTS

| | | | |
|---|---|---|---|
| DE | 34465019 | A1 | 12/1984 |
| EP | 0976897 | A1 | 2/2000 |
| EP | 0991026 | A2 | 4/2000 |
| GB | 2129176 | A | 10/1983 |
| GB | 2306725 | A | 5/1997 |
| WO | 87058/P | CT | 7/2000 |

OTHER PUBLICATIONS

US 20001/0033228, Oct. 2001, Kisreman et al.*

* cited by examiner

*Primary Examiner*—Peter M. Poon
*Assistant Examiner*—Troy Chambers
(74) *Attorney, Agent, or Firm*—Thomas R. FitzGerald, Esq.

(57) ABSTRACT

The present invention relates to a weapon safeguarding system with a first contact-sensitive user interface for receiving use data characterizing a user. In this connection the first contact-sensitive use interface is arranged in a contact region of a weapon which is contacted by the user with a view to firing a shot. The weapon safeguarding system further comprises a control device which comprises an input unit for receiving the user data, a computer unit for verifying the user data and an output unit. In the case of a successful verification of the user data, which indicates that the user is a user who is authorized for use, the output unit outputs a release signal in order to release a discharging mechanism of the weapon. In order to provide the user data to the first contact-sensitive use interface, the weapon safeguarding system comprises a user terminal which contains the user data and a body transmission device connected to the user for the purpose of transmitting the user data to the first contact-sensitive use interface in the event of contact therewith.

16 Claims, 6 Drawing Sheets

WEAPON SAFEGUARDING SYSTEM AND PROCESS

CROSS-REFERENCE TO RELATED APPLICATION

This application claims priority of German Patent Application 100 37 227.9, filed Jul. 31, 2000.

FIELD OF THE INVENTION

The present invention relates to weapon safeguarding systems and processes that prevent an unauthorized use of weapons. In particular, the present invention relates to a weapon safeguarding system and a weapon safeguarding process in which the authorization (authority for use) of a user is verified prior to a release of weapons for firing. The present invention is also concerned with systems and processes for identifying users and, in particular, with systems and processes for the action-integrated identification of users.

BACKGROUND OF THE INVENTION

The prior state of the art is represented by one or more of the following patents. U.S. Pat. No. 5,603,179 discloses a safety mechanism for a weapon, wherein a specialized scanning mechanism is built into the trigger of the weapon. The scanning mechanism reads the unique fingerprints of a user of the weapon for an user identification. Here, only by biometrical data of a user are used for his/her identification. A transmission in the true sense of the word of data to the weapon is not disclosed. Moreover, this safety mechanism includes only one scanning mechanism.

Comparable thereto, U.S. Pat. No. 6,185,852 discloses an electronic weapon safety system wherein, by means of a fingerprint sensing and verification circuitry, fingerprints of a user are sensed and verified for a user identification. Again, biometrical data are employed for user identification, but no data transmissions as such. Further sensing means responding to a physical contact by a user are not disclosed.

U.S. Pat. Nos. 6,234,271 and 6,363,647 disclose comparable firearm safety systems. The safety systems are operated in response to user identifying data which are transmitted as wireless signals for example as radio frequency (rf) signals. Means for receiving such user identifying signal will allow a use of a firearm with this safety system if the received data indicate that the current user is authorized for using the firearm. Further means for receiving such user identifying data are not disclosed.

Comparable thereto, US-2001/0033228 A1 employs wireless transmitted user identifying data signals transmitted from a remote unit for verifying the authorization of a user wanting to use a weapon. For a wireless transmission of user identifying data to a weapon, U.S. Pat. No. 5,461,812 discloses a ring to be worn by a user of the weapon. The ring includes means for generating transponder signals as user identifying data.

U.S. Pat. No. 6,343,140 B1 discloses a mechanism for use in combination with a weapon, wherein the mechanism determines a present biometric signature of a user who desires to use the weapon. This mechanism only allows a use of a weapon if the currently sensed biometric signature of the user is recognized. In particular, electric and/or magnetic properties of the skin of a user are employed as biometric signature. User identifying data transmitted from a user terminal via the body of a user are not disclosed. Further, it is not disclosed to use further means for receiving user identifying data beside the named mechanism.

U.S. Pat. No. 6,301,815 B1 discloses a system for limiting the use of weapons. Here, controlling the use of a weapon is accomplished by means of a base unit. Weapons used in combination with the base unit do not include itself any means for verification of a user identity to provide for a use of the weapon by authorized users only.

U.S. Pat. No. 6,260,300 131 discloses a locking container for weapons. The locking container includes means for scanning of biometric data of a user and means for verifying the identity and authorization of a user. In case a biometric data of a user, in particular a fingerprint, indicates that the user is allowed to use a weapon locked in the container, the container can be opened by the user. Further, it is contemplated that, in case of a successful verification of biometric data of a user, the locking container enables, beside an unlocking of the locking container, an operation of a weapon having electronic controls. Further means for receiving user identifying data are not disclosed. Further, this locking container serving as security unit is not attached to a weapon to being controlled. Rather it encloses such a weapon.

EP-0 976 897 A1, GB-2 306 725 A, U.S. Pat. Nos. 5,359,322, 5,204,672, 5,811,897, 5,172,967 and GB-2 129 176 disclose systems and methods for identification of a user. These prior art documents do not relate to security systems for weapons.

Portable firearms, including and not limited to handguns and rifles (hereinafter "weapons") are traditionally safeguarded against undesirable, unintentional use or discharge. It is important to guard against the accidental operation of the trigger in case the trigger is subjected to a shock or other vibration. A conventional safeguard is a mechanical trigger lock. However, such locks do not prevent unauthorized persons from using the weapons because the mechanical lock can be opened at any time and by anyone. Other safeguards against an unauthorized use of weapons are lockable locking devices on the movable, shot-discharging components (e.g. hammer, slide, cylinder), or the ammunition or ammunition-bearing components (cylinder, magazine) can be removed. Although such safeguards render the make it difficult to use a weapon, they do not constitute a genuine safeguard because the weapons can still be operated by persons in possession of appropriate keys, ammunition or ammunition-bearing components. Owners of weapons with locks often do not use the locks because the locks are inconvenient. Before the weapon can be used the locking devices has to be removed, or the weapons have to be loaded, in order to bring them back into a state in which they are ready for operation. The time required for enabling a weapon may be critical and short as in the case of emergency situations in the event of an attack and in the case of operations by the police or the military.

In order to safeguard weapons against unauthorized use while still providing simultaneous rapid availability, so-called personalized weapons have been proposed. Such weapons are also as "smart guns". Personalized weapons have safeguarding devices that enable the weapons to be used only by authorized users. Examples of personalized weapons are (a) weapons with devices for recording fingerprints or impressions of the ball of the thumb, (b) weapons with internal locking mechanisms that are unlocked by a magnet carried by an authorized user, and (c) weapons with devices for entering user codes and with locking devices that are connected to a receiver and unlocked in response to a radio signal transmitted by a transmitter carried by an authorized user.

Safeguards that depend upon devices for recording fingerprints or impressions of the ball of the thumb are unreliable. If the fingerprint or the impression of the ball of the thumb has been changed, for example by reason of a slight injury, there is no guarantee that the weapons will be released, even in the case where they are being used by authorized users. Such safeguards will not release the weapon if the user wears gloves because the fingerprint or the impression of the ball of the thumb cannot be recorded through the glove. Another disadvantage is the complex, cost-intensive and trouble-prone structure of such safeguarding devices. A modification of these recording devices, in which the force generated by the finger or by the ball of the thumb is recorded and compared with a predetermined force, also does not guarantee a reliable release of these weapons, since the force actually generated by a user may vary greatly in relation to the predetermined force, particularly in emergency situations.

Others have propose using speech-recognition devices but are also unsatisfactory. Simple speech-recognition devices do not permit unequivocal identification of different users having similar speech and more complex speech-recognition devices may not release the weapons for authorized users if the voice of such authorized users has been changed in comparison with their normal speech, for example by reason of ambient noises, illness of the respiratory tract, psychological influences (e.g. stress in emergency situations).

The disadvantages of the above, conventional safeguard devices for personalized weapons are overcome when the weapon is equipped with a locking device that is operated in conjunction with a receiver. Such weapons are reliably released if the user carries a transmitter and transmits appropriate data. It is a disadvantage that weapons of this type are also released when they are used in unauthorized manner while a suitable transmitter is located in the vicinity. Thus, for example, a pistol that is safeguarded in this way can also be used against a police officer carrying a transmitter who has lost the pistol in a scuffle. This problem also exists in the case of personalized weapons exhibiting a safeguarding device that is capable of being unlocked via a magnet. In addition, such magnetically releasable weapons can be used in unauthorized manner at any time, as long as any suitable magnet is used.

In order to release a personalized weapon with a code-input device it is necessary for a user to enter a valid code. The length of time needed for this is in conflict with a release of the weapons that is as rapid as possible and that may be life-saving.

A further disadvantage of these known weapon safeguards consists in the fact that the weapons remain ready for firing after a release for an authorized user and can consequently also be used by unauthorized persons at any time. The weapons are only locked again if an (authorized) user takes appropriate measures, i.e. performs locking actively, for example by entering an appropriate code, or takes the weapon out of the effective range of devices for the non-contacting release of weapons (e.g. magnets, radio transmitters).

The prior state of the art is represented by one or more of the following patents. U.S. Pat. No. 5,603,179 discloses a safety mechanism for a weapon, wherein a specialized scanning mechanism is built into the trigger of the weapon. The scanning mechanism reads the unique fingerprints of a user of the weapon to identify the user. Here, only by biometrical data of a user are used for his/her identification. A transmission in the true sense of the word of data to the weapon is not disclosed. Moreover, this safety mechanism includes only one scanning mechanism.

Comparable thereto, U.S. Pat. No. 6,185,852 discloses an electronic weapon safety system wherein, by means of a fingerprint sensing and verification circuitry, fingerprints of a user are sensed and verified to identify the user. Again, biometrical data are employed for user identification, but no data transmissions as such. Further sensing means responding to a physical contact by a user are not disclosed.

U.S. Pat. Nos. 6,234,271 and 6,363,647 disclose comparable firearm safety systems. The safety systems are operated in response to user identifying data which are transmitted as wireless signals for example as radio frequency (rf) signals. Means for receiving such user identifying signal will allow a use of a firearm with this safety system if the received data indicate that the current user is authorized for using the firearm. Further means for receiving such user identifying data are not disclosed.

Comparable thereto, US-2001/0033228 A1 employs wireless transmitted user identifying data signals transmitted from a remote unit for verifying the authorization of a user wanting to use a weapon. For a wireless transmission of user identifying data to a weapon, U.S. Pat. No. 5,461,812 discloses a ring to be worn by a user of the weapon. The ring includes means for generating transponder signals as user identifying data.

U.S. Pat. No. 6,343,140 B1 discloses a mechanism for use in combination with a weapon, wherein the mechanism determines a present biometric signature of a user who desires to use the weapon. This mechanism only allows a use of a weapon if the currently sensed biometric signature of the user is recognized. In particular, electric and/or magnetic properties of the skin of a user are employed as biometric signature. User identifying data transmitted from a user terminal via the body of a user are not disclosed. Further, it is not disclosed to use further means for receiving user identifying data beside the named mechanism.

U.S. Pat. No. 6,301,815 B1 discloses a system for limiting the use of weapons. Here, controlling the use of a weapon is accomplished by means of a base unit. Weapons used in combination with the base unit do not include itself any means for verification of a user identity to provide for a use of the weapon by authorized users only.

U.S. Pat. No. 6,260,300 131 discloses a locking container for weapons. The locking container includes means for scanning of biometric data of a user and means for verifying the identity and authorization of a user. In case a biometric data of a user, in particular a fingerprint, indicates that the user is allowed to use a weapon locked in the container, the container can be opened by the user. Further, it is contemplated that, in case of a successful verification of biometric data of a user, the locking container enables, besides an unlocking of the locking container, an operation of a weapon having electronic controls. Further means for receiving user identifying data are not disclosed. Further, this locking container serving as security unit is not attached to a weapon to being controlled. Rather it encloses such a weapon.

EP-0 976 897 A1, GB-2 306 725 A, U.S. Pat. Nos. 5,359,322, 5,204,672, 5,811,897, 5,172,967 and GB-2 129 176 disclose systems and methods for identification of a user. These prior art documents do not relate to security systems for weapons.

OBJECT OF THE INVENTION

One purpose of the invention is to make a safeguarding system and a safeguarding process for portable firearms that release the weapons only for use by authorized persons. Another purpose is to prevent unauthorized persons from firing weapons in an unauthorized manner. In order to eliminate the aforementioned disadvantages of known weapon safeguards, the invention releases the weapons for authorized persons and the blocks of the weapons for unauthorized persons in a reliable and straightforward manner. In particular, the invention releases and blocks operation of weapons in person-dependent manner prior to each individual use, i.e. before each shot. For this purpose the invention enables the release of the weapon in an manner consistent with conventional use of an unsafeguarded weapon. An authorized person only has to perform the actions that are normally required for firing a traditional, non-safeguarded weapons and does not have to perform any other release actions. Similarly, the invention blocks the weapon without additional steps, so that an unauthorized person who operates the weapon in traditional manner is unable to fire a shot.

BRIEF DESCRIPTION OF THE INVENTION

The approach underlying the invention is to assign unique, personal user data to any person who is authorized to use a given weapon or to two or more persons for their joint use of one or more weapons. The weapon stores user data in a memory. In order to release a weapon, that user data must be supplied to the weapon by the intended user. An authorized user is equipped with a transmitter to transmit his or her user data to the weapon. Transmission is by physical contact with the weapon. The contact which is necessary for the transmission of user data requires no additional action on the part of the user. Consequently the transmission of the user data for releasing the weapon, and the verification of said user data as to whether the current user is an authorized user for that particular weapon, is action-integrated. In other words, the process is carried out intuitively by the respective user. Prior to each discharge of the weapon, the invention transmits user data to the weapon and the weapon verifies the user data. Therefore, an unauthorized person cannot use a weapon equipped with the invention, even if the weapon was used immediately beforehand by an authorized person. In the case of automatic weapons, which are able to fire several shots in succession when the discharging mechanism is actuated, the release, in accordance with the invention, of the weapon takes place prior to each actuation of the discharging mechanism.

With a view to realizing the invention, a weapon safeguarding system is provided that has a first contact-sensitive use interface for receiving user data characterizing a user. The data are transmitted via the user's body. The user is equipped with a user terminal that outputs the user data via the body of the user. The first contact-sensitive use interface is fitted in a contact region of a weapon that normally is contacted by the user who plans to fire the weapon. In order to guarantee that the user contacts the first contact-sensitive use interface when using the weapon, that interface is fitted to the trigger of the weapon, to the grip of the weapon or in an appropriate region of the barrel of the weapon. The interface has a contact-sensitive surface that is large enough to ensure that the user cannot fail to touch the first contact-sensitive use interface. In this way the contact-sensitive surface of the first contact-sensitive use interface may be configured in such a way that it covers the (entire) contact region of the trigger, one or both butt plates and/or a substantial part of the underside of the barrel.

The weapon safeguarding system according to the invention further comprises a control device with an input unit for receiving the user data from the first contact-sensitive use interface. The control device includes a computing unit for storing and verifying the received user data and an output unit for outputting a release signal in the case of a successful verification of the user data, which indicates that the current user is an authorized user. In particular, the release signal is a signal that can be used for the purpose of releasing a discharging mechanism of the weapon.

The invention provides that only one actuation of the discharging mechanism is necessary to enable the weapon for firing by an authorized person. This is done by locating the first contact-sensitive use on the trigger of the weapon. Under certain circumstances it may be necessary to enable rapid, repeated discharges of the weapon. In that case, the invention provides a second contact area. When the two area are used, the time to reverify the user between sequential discharges is materially reduced. To this end, the first contact-sensitive use interface should preferably be configured in such a way that it provides, not only on the trigger of the weapon but also in at least one other region of the weapon, a contact-sensitive surface for transmitting user data that has to be contacted when the weapon is used (e.g. grip, barrel, shoulder support) but does not result in an actuation of the discharging mechanism. In this way it is possible, via the parts of the first contact-sensitive use interface that are not to be arranged in the region of the trigger, to receive the user data and to evaluate them fully in order to determine whether the current user is an authorized user. In the case of a successful verification of the user data, the weapon is released when the discharging mechanism is actuated, for example, via the trigger. The corresponding region of the first contact-sensitive use interface receives the user but the user data are only verified partially or in simplified manner, in order to minimize the length of time up until the actual release of the weapon.

The output unit of the weapon safeguarding system according to the invention preferably also serves for the output of a blocking signal in the case of a failed verification of the user data. The invention thus provides a blocking signal for blocking the discharging mechanism. In this way it is also possible to activate an additional blocking or locking device which is normally deactivated, even in a non-released operating state of the weapon. Thus, for example, the blocking signal can be used in order to lock the hammer or the cylinder of a weapon or in order to prevent the supply of ammunition.

The weapon safeguarding system according to the invention may further comprise a release device that releases the discharging mechanism in response to the release signal and/or for the purpose of blocking the discharging mechanism in response to the blocking signal.

In order to transmit the user data to the first contact-sensitive use interface, the user terminal contains the user data and a body transmission device that is capable of being connected to the user in electrically conducting manner. The user terminal transmits the user data via the body transmission device and the body (e.g. the skin) of the respective user to the first use interfaces if the user contacts said first use interface. It is well known that the skin is conductive and is capable of carrying a data message over its surface.

In order to ensure that the transmission of user data is guaranteed even when the user wears gloves, the user terminal may comprise a (several) glove(s) that is/are electrically conducting at least in the regions that contact the first contact-sensitive use interface when the weapon is being used. It is furthermore possible to provide a user terminal in the form of a glove that comprises a device containing the user data and a transmission device which transmits the user data to the first contact-sensitive use interface via conductive regions of the glove.

The user terminal preferably transmits the user data continuously, in order to ensure that the user data are made available every time the weapon is contacted.

In addition, the weapon safeguarding system according to the invention may have it a second contact-sensitive use interface for receiving the user data. The second contact-sensitive use interface is connected to the input unit and is capable of being fitted outside the contact region of the weapon. The second contact-sensitive use interface is used to test and verify the functioning of the weapon safeguarding system according to the invention. The system is operated in a test mode when the user data are received via the second contact-sensitive use interface. In this connection the output unit is designed to generate an output release test signal. That output release test signal is not capable of releasing the discharging mechanism of the weapon in response to a successful verification of the user data in the test mode.

In a similar manner the invention provides a blocking test signal. That signal operates in a manner comparable to normal operation of the weapon safeguarding system. The blocking test signal is not capable of being used for the purpose of blocking the discharging mechanism. It is output by the output unit in response to a failed verification of the user data in the test mode.

In order also to be able to check the release device in the test mode, the release device can be activated in the sense of a release of the weapon in response to the release test signal without thereby actually being able to change the current state of the discharging mechanism. Similarly, the release device in the test mode can be activated in the sense of a blocking of the weapon in response to the blocking test signal, whereby no actual change of state of the discharging mechanism can be brought about.

In order in the test mode also to check the first contact-sensitive use interface and the transmission to the control device of user data pertaining to said use interface, the input unit exhibits a first input connected to the first contact-sensitive use interface and a second input connected to the second contact-sensitive use interface. Furthermore, the output unit is connected to the first contact-sensitive use interface for the purpose of transmitting the user data received from the second contact-sensitive use interface, whereby the computer unit receives and verifies the user data received from the second contact-sensitive use interface via the first input.

Furthermore, the invention provides that the weapon safeguarding system according to the invention comprises an indicating device for indicating the result of a verification of the user data and/or for indicating the operating state of the weapon safeguarding system. The results of the test mode about the operational capability of the weapon are immediately available to the current user of the weapon. In the case of normal operation of the weapon safeguarding system according to the invention, i.e. not in the test mode, the current user recognizes immediately whether the weapon is in fact released or blocked. Indication of the state of a power supply for the system according to the invention is also possible in this way. A further advantage of the indicating device consists in the fact that persons are given an indication that an unauthorized person is using the weapon in unauthorized manner. For this purpose, use may be made of, for example, light-generating means (e.g. LEDs) and/or acoustic signal generators (e.g. acoustic piezoelectric transducers) which are arranged by way of indicating device in the muzzle region of the weapon. If, for example, in the course of a police operation a police officer who is authorized for the use of a weapon has the weapon stolen from him and aimed at him, he is immediately informed that the weapon is in an inoperable state (not ready-to-fire) and can take action in "reassured" manner against the respective unauthorized user of the weapon.

The release device preferably comprises an electromagnetic actuator with which movable components of the discharging mechanism of the weapon can be released and/or locked. The use of an electromagnetic actuator by way of release device permits said device to be activated in straightforward manner as above in the test mode without this being able to cause an actual release or blocking of the weapon. For this purpose, use is made of the release test signal or the blocking test signal in order to bring about activation (movement) of the electromagnetic actuator that cannot give rise to a release or blocking of the weapon.

In the case of an electromagnetic actuator release device, the operational capability of the release device can be indicated in straightforward manner. Light-emitting diodes are used to indicate an activation of the release device for the purpose of releasing or blocking the weapon and/or in the sense of a release or blocking of the weapon. The LEDs emit light by reason of currents that have arisen as a result of inductive effects in the electromagnetic actuator in the course of deactivation.

An improved safeguarding of weapons can be obtained if the weapon safeguarding system according to the invention has a radio unit for the purpose of receiving control data for the control device and/or for the purpose of transmitting data that reproduce the signals of the output unit and/or the operating state of the weapon safeguarding system. The control data comprise data or items of information that specify the authorization of individual users or of several users for the weapon in question and that are used by the control device for the purpose of verifying currently received user data, data in the form of a software program and data for the general release or blocking of the weapon. The data transmitted by the radio unit can be used in order to record operating states of the weapon safeguarding system according to the invention as well as operating states for a corresponding weapon, in order to ascertain the current user or in order to determine whether an unauthorized user is attempting to use the weapon.

In this case the invention provides for making use of a central controller which exhibits a transmission device for transmitting the control data and/or for receiving the data pertaining to the radio unit.

The invention further provides a weapon, more precisely a portable firearm, that exhibits one of the previously described embodiments of the weapon safeguarding system according to the invention.

An improved safeguard against an unauthorized use of the weapon is obtained if the contact region of the weapon is an electrically conducting region which emits a voltage, for example a high voltage, in response to the blocking signal in order to deter an unauthorized user.

The object of the invention is also achieved by a weapon safeguarding system that comprises the following steps:

providing a first contact-sensitive use interface in a contact region of a weapon that is contacted by a user with a view to firing a shot, contacting the first contact-sensitive use interface by the user whose body is connected to the user terminal in electrically conducting manner, whereby the user terminal outputs the user data via the body of the user, transmitting user data characterizing the user from a user terminal that is connected to the user in electrically conducting manner via the body of the user, verifying the user data in order to determine whether the user is an authorized user, and outputting a release signal in the case of a successful verification of the user data with a view to releasing a discharging mechanism of the weapon.

Further features and advantages of the invention will become apparent from the appended subordinate claims.

BRIEF DESCRIPTION OF THE FIGURES

Preferred embodiments of the invention are described in the following with reference to the appended Figures, in which there are shown.

DESCRIPTION OF PREFERRED EMBODIMENTS

In order to implement an action-integrated identification of a user, a device is required that in the event of an action of the user, more precisely in the event of a contact with a suitable use interface, makes available required data that characterize the user with a view to identifying the user. For this purpose, use is made of an enduser apparatus which is also designated as a personal code repeater and which contains the data characterizing the user, hereinafter called user data for short. In addition to data that immediately characterize a user (e.g. by virtue of a code), the user data may also comprise further user-specific and/or application-specific data.

Figure 1:
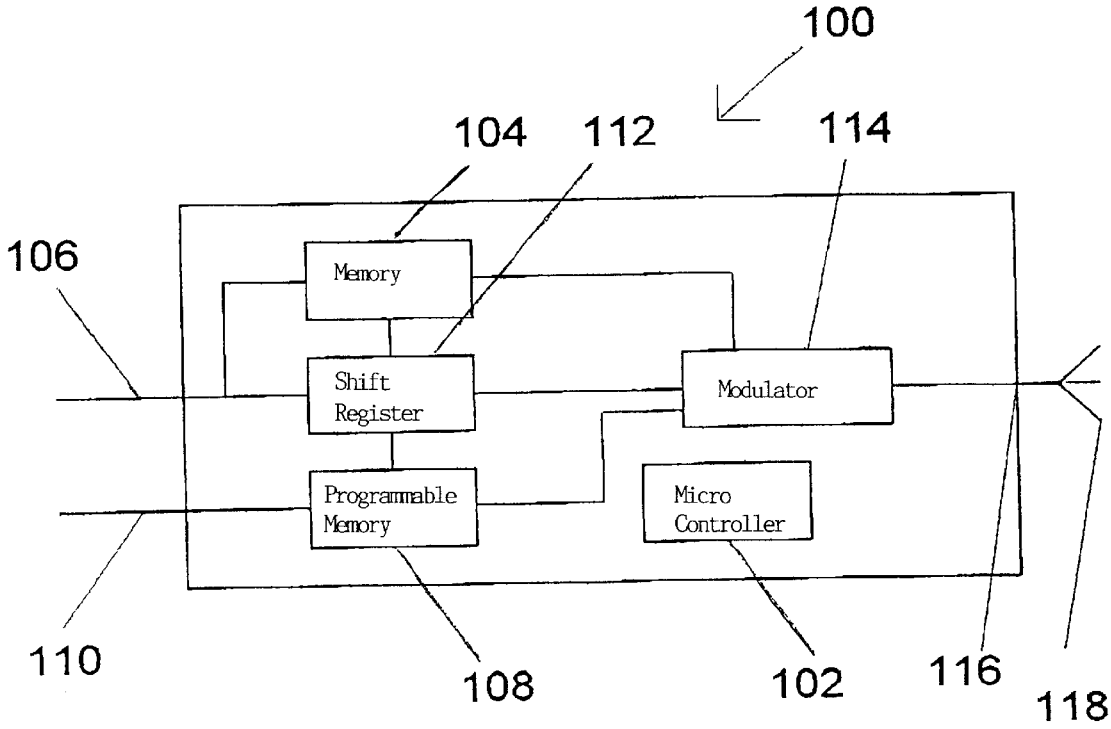
FIG. 1 a schematic representation of a user terminal for use in connection with the invention, FIG. 2 a schematic representation of an embodiment of the weapon safeguarding system according to the invention, FIG. 3 a schematic representation of another embodiment of the weapon safeguarding system according to the invention, FIG. 4 a schematic representation of an embodiment of a release device for the weapon safeguarding system according to FIGS. 2 and 3, FIG. 5 a schematic representation of a pistol that is safeguarded in accordance with the invention, and FIG. 6 a schematic representation of a rifle that is safeguarded in accordance with the invention.

The end-user apparatus 100 represented in FIG. 1 is controlled by a microcontroller 102. User data which are supplied via an external data input 106 and which can be replaced by new user data via the data input 106 are stored in a memory 104. In order to store data permanently in the end-user apparatus 100, a programmable memory 108 is present which via an external programming input 110 receives user data to be stored permanently ("burnt in"). Whether the user data in the memory 104 are erasable or permanently stored in the programmable memory 108 depends on the application of the user terminal.

With a view to transmitting the user data in the memories 104 and/or 108, the latter are connected to a shift register 112. The use of the shift register 112 makes it possible to transmit the user data repetitively (e.g—continuously, at predetermined time-intervals, at predetermined times.) In this way it is guaranteed that the user data are made available every time a corresponding use interface is contacted. The user data that are output by the shift register 112 are modulated by a modulator 114. The user data that are modulated by the modulator 114 are transmitted via an output 116 to a body transmission device 118 which is connected to the body of the user in electrically conducting manner and which transmits the user data via the body and, in particular, via the skin of the user.

Furthermore, the body transmission device 118 can also receive data and transmit them to the memories 104 and 108. In this way the functions provided by the inputs 106 and 110 can also be realized via the body transmission device 118.

In the case of an embodiment of the end-user apparatus 100 which is not shown, the memories 104 and 108 are not present. In this case, user data to be transmitted are input directly via the external data input 106 into the shift register 112 which contains the supplied user data until such time as the power supply of the end-user apparatus 100, which is realized by a battery for example, is exhausted. This limitation of the life span of the end-user apparatus 100 may be entirely desirable if, for example, the end-user apparatus 100 is to provide user data only during a predetermined period of time (e.g. the duration of a temporally limited employment). In this connection, use may be made of a capacitor, in the form of a gold cup for example, instead of a battery if the end-user apparatus 100 is to be ready for operation only for a very short time.

In order to inform the user of the end-user apparatus 100 about the current state of the power supply of said end-user apparatus, the end-user apparatus 100 may comprise an optical and/or acoustic power-supply indicating unit. For this purpose, use may be made of light-generating means, the luminous intensity of which depends on the current state of the power supply, graphic displays (e.g. LCD displays) which indicate the current state of the power supply, for example in the form of a scale, and acoustic signal generators which inform the user by generating an acoustic warning signal if the power supply is running out.

In order to make the user data that are required for the identification of the user available to a system for the identification of a user which is described in more detailed manner in the following, the user contacts a contact-sensitive use interface which is likewise described in the following. The user data are transmitted via the body transmission device 118 and the body of the user to the contact-sensitive use interface and are used for the purpose of identifying the user in the following way.

Figure 2:
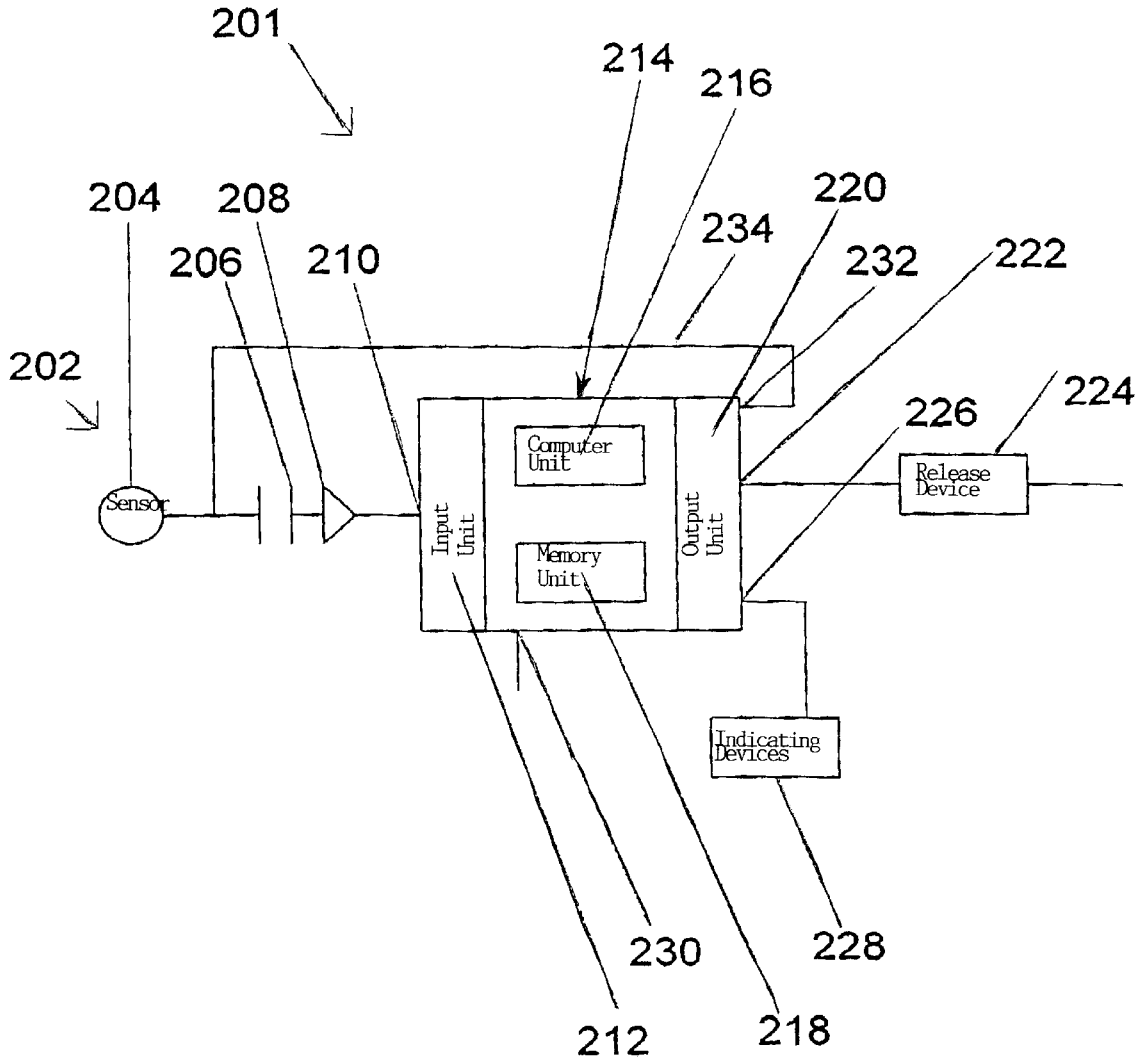

A system 201 which is shown in FIG. 2 for the identification of a user comprises a first contact-sensitive use interface 202 with an electrically conducting material forming a sensor 204, with a capacitor 206 and a trigger amplifier 208.

Figure 3:
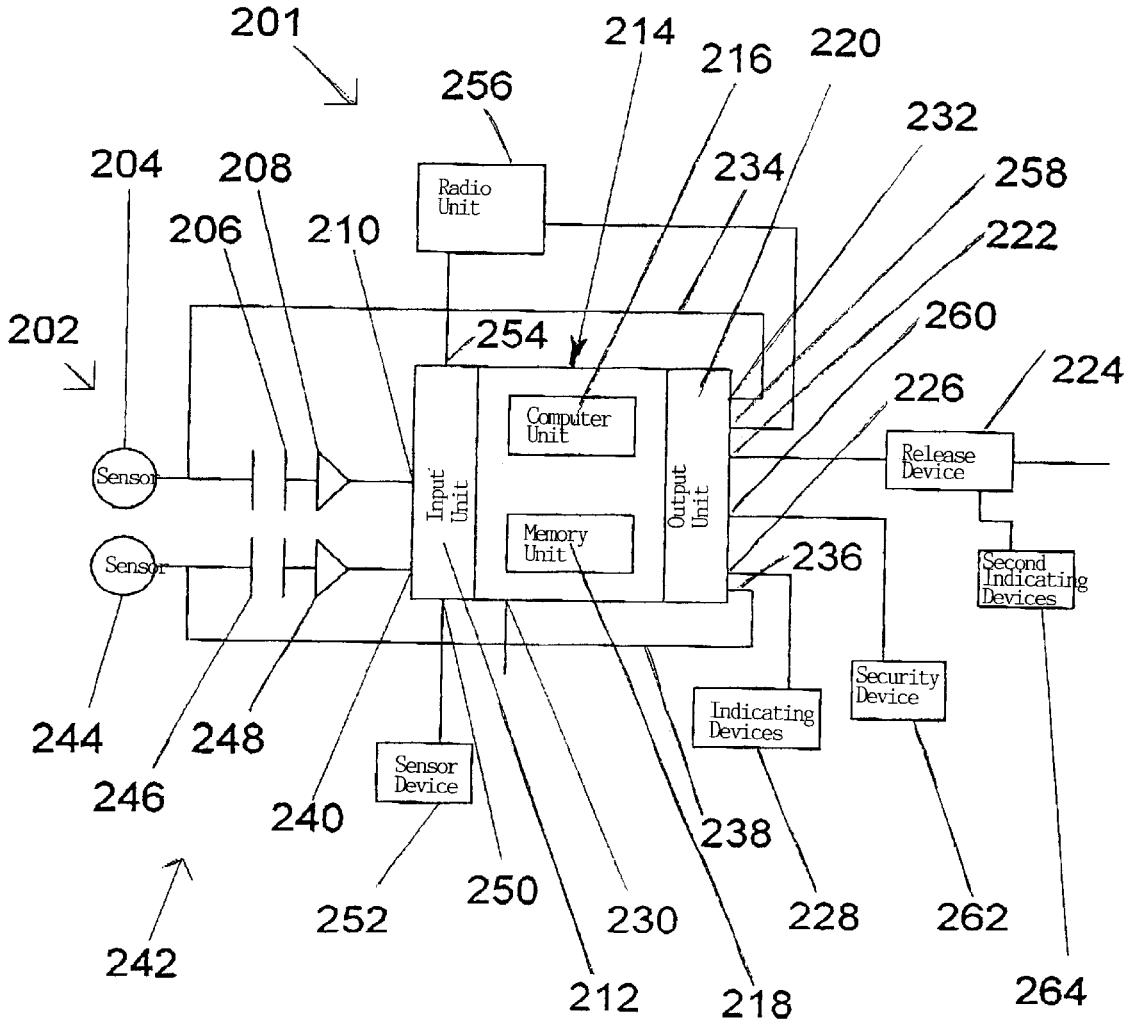

The sensor 204 which is represented in FIGS. 2 and 3 as an individual subassembly may also comprise several sensors or sensor components in order to provide the contact-sensitive function of the first contact-sensitive use interface 202 also in regions that are spaced from one another.

The trigger amplifier 208 is connected via an input 210 to an input unit 212 of a control device 214. The control device 214 exhibits a computer unit 216 connected to the input unit 212, a memory unit 218 assigned to the computer unit 216 and an output unit 220 connected to the computer unit 216.

Figure 4:
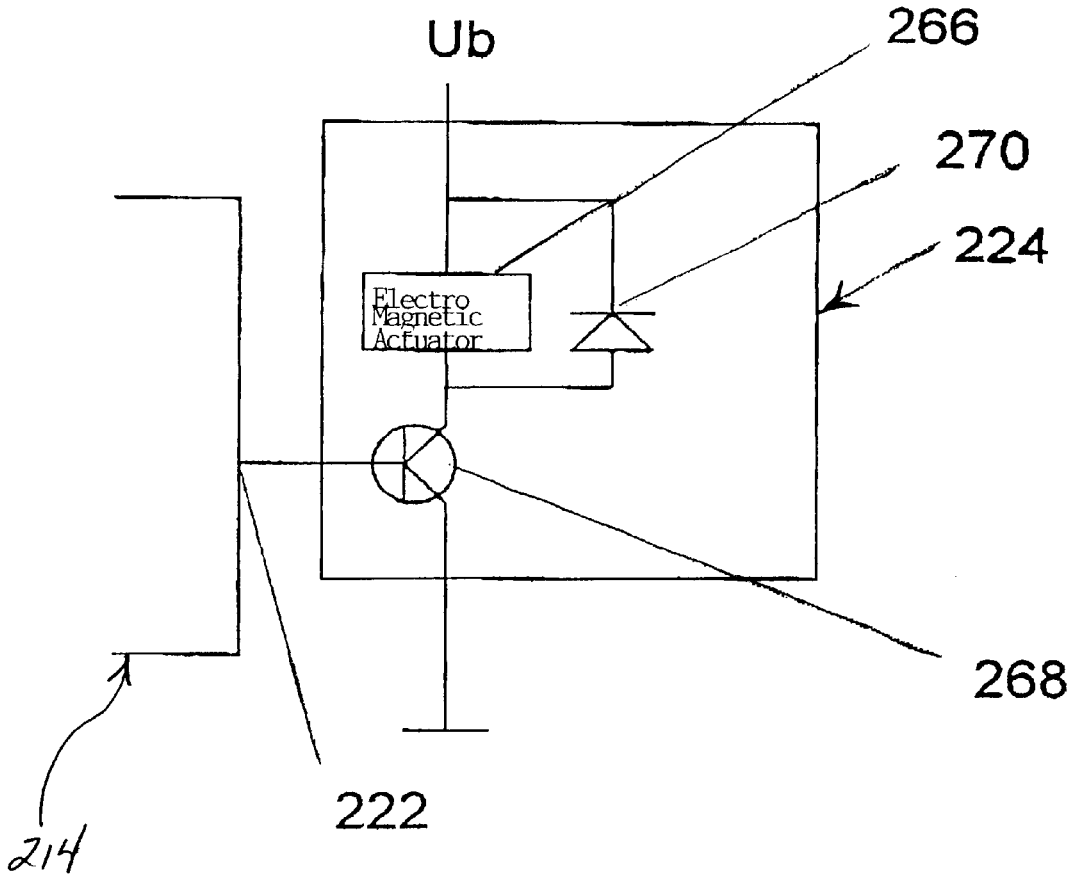

A release device 224 which is described in more detailed manner in the following with reference to FIG. 4 is connected up via an output 222. Indicating devices $\mathbf{228}_1$, $\mathbf{228}_n$ are connected to the output unit 220 via outputs $\mathbf{226}_1, \ldots,$ $\mathbf{226}_n$. The indicating devices 228 may be, for example, light-generating means (LEDs) which emit light of varying wavelengths (e.g. red, green, yellow light). Use may also be made, for example, of an alphanumeric and/or graphic display (LCD display) which performs the functions, described in the following, of the indicating devices $\mathbf{228}_1, \ldots, \mathbf{228}_n$. In this case only one output 226 may be required, depending on the indicating devices 228 being used.

The control device 214 further exhibits a data interface 230 as well as an output 232 and a connection 234 from the output 232 to the first contact-sensitive use interface 202.

With a view to operating the system 201 for identifying a user, the system 201 is activated by the sensor 204 being contacted by the user, for example with a finger. As a result of the contact, a hum voltage in the range from 30 to 100 Hz is supplied to the trigger amplifier 208 via the capacitor 206. The trigger amplifier 208 generates a square-wave signal and supplies this to the input 210 of the control device 214. The control device 214 is preferably operated in a current-saving sleep mode until such time as the control device 214 receives a rectangular amplified hum voltage by virtue of the square-wave signal supplied by the trigger amplifier 208 and "wakes up". In this way a power supply (not shown) of the system 201 is treated sparingly.

In order, in the event of the sensor 204 being contacted, to transmit user data to the system 201 via the body transmission device of the user terminal 100 which is connected to the body of the user in electrically conducting manner, the surface of the sensor 204 is electrically conducting. The user data are transmitted to the computer unit 216 via the input 210 and the input unit and are verified by said computer unit, whereby the computer unit 216 accesses the memory unit 218 in order to obtain data that are suitable for verifying the user data. The data or items of information, for example in the form of a software program, that are required for operation of the control device 214 and, in particular, of the computer unit 216, may be available in a volatile memory which is not shown and which is preprogrammed in the course of production of the system 201 or is programmed prior to initial operation of the system 201 via the data interface 230. These data or items of information may also be stored in the erasable memory unit 218, in order to be capable of being updated via the data interface 230. An activation and deactivation of the system 201 can also be obtained in this way, in order to bring about a fundamental blocking or release of subordinate devices and appliances.

The data that are used for the purpose of verifying the user data and that are partially stored in the memory unit 218 comprise the user data pertaining to one or more authorized users and, depending on the particular application of the system 201, further data, called release data for short, which are used for the purpose of controlling the release device 224, as described in the following. In order to update these data, for example in order to add new user data pertaining to additional authorized users, to erase or amend existing data, and also to add, amend or erase release data, appropriate data pertaining to an external appliance (not shown) are supplied via the data interfaces 230 and/or the user terminal 100. In this way the user terminal 100 can also be used in order to amend one's own user data and/or other people's user data pertaining to the system 201 if the user terminal 100 is authorized for this purpose, e.g. by appropriate release data or control data.

In the course of verification of the user data received via the contact-sensitive use interface 202 the computer unit 216 compares said user data with the user data pertaining to the memory unit 218. This verification is concluded successfully if the received user data coincide with the stored user data for an authorized user or with user data pertaining to an authorized user of the stored user data for several users. If no user data that coincide with the received user data are present in the memory unit 218, the verification by the computer unit 216 has failed.

In the case of a successful verification of the received user data the control device 214 generates a release signal, and in the case of a failed verification it generates a blocking signal, which are output respectively via the output unit 220 and the outputs 222 and 226 to the release device 224 and to the indicating devices 228. These signals may also comprise information being indicative of one or more periods of time for release/blocking operations, time-intervals to be observed between consecutive release/blocking operations, a maximum number of release/blocking operations and different types of release (e.g. different access authorizations). Furthermore, the invention provides that these signals are transmitted at least partially to the user terminal 100 via the output 232, the connection 234 and the first use interface 202. If, for example, use is made of several systems 201, it is possible in this way to enable a release by one of the systems 201 only when the user terminal 100 transmits data that indicate a release by another (previously used system) of the systems 201 (this linked use of several systems 201 is also designated as "daisy-chaining").

Depending on the respective signal that is output by the output unit 220, the release device 224 in conjunction with the system 201 releases devices or appliances being used for use by an authorized user or blocks said devices or appliances so that an unauthorized user has no access to them. For this purpose the release device 224 can generate suitable control signals and output them to the devices and appliances and/or mechanically release or block the use thereof. The operation of the release device 224 is described in more detailed manner further below with reference to FIG. 4.

The release or blocking by the release device 224 can also be effected as a function of the release data. The release data define additional conditions that have to be satisfied in order that an authorized user can make use of subordinate devices and appliances. Examples are the definition of one or more periods of time for release operations, time-intervals to be observed between consecutive release operations, a maximum number of release operations and different types of release (e.g. different access authorizations). The release data may also contain information about the use of further systems 201 and/or of other identification or safeguarding systems ("daisy-chaining").

In order to indicate the result of the verification of the user data to the user, the indicating devices 228 are operated as a function of the release signals and blocking signals that are output by the output unit 220. In the simplest case the indicating devices 228 comprise light-generating means emitting light of different wavelengths, for example a red LED and a green LED. If a release signal is present and if accordingly a device or appliance that is connected to the system 201 is released for use by the user, this is indicated to the user by one of the light-generating means, for example the green LED, lighting up. If the verification of the user data has failed and brings about a blocking of the use of the device or appliance by the release unit 224, the user recognizes this from the operation of the other light-generating means, for example the red LED. In addition or optionally, the indicating devices 228 may also comprise acoustic signal generators which, depending on the release signals and blocking signals, generate tones of differing intensity and frequency or appropriate voice signals (e.g.: "release", "no valid authorization—no release"). In particular if the system 201 is being used in conjunction with portable devices and appliances and consequently only a limited power supply is available, the indicating devices 228 are also used for the purpose of indicating the current state of the power supply.

For the purpose of verifying the operational capability, the system 201 is operated in a test mode. In the test mode the control device 214 generates, using the user data stored in the memory unit 218, a signal that reproduces the user data that are stored for an authorized user. This signal, which is designated in the following as a user-data test signal, is supplied to the input 210 of the control device 214 via the output 232 of the output unit 220 via the connection 234. In the case of the embodiment represented in FIG. 2 the user-data test signal is passed to the input 210 via the capacitor 206 and the trigger amplifier 208, in order also to test the capacitor 206 and the trigger amplifier 208. But the user-data test signal may also be transmitted to the input 210 directly via the connection 234 if, for example, the components 204, 206 and 208 of the contact-sensitive use interface 202 are integrated as a structural unit.

The user-data test signal reproducing the user data is verified like user data that are provided via the contact-sensitive use interface 202. In contrast to the verification of user data described above, no release signals or blocking signals are generated in response to the verification of the user-data test signal, in order to prevent the system 201 which is being operated in the test mode from actually releasing or blocking devices and appliances that are connected via the release device 224. Therefore a release test signal and a blocking test signal are generated which are each output to the indicating devices 228 via the outputs 226. In response to the release received test signal or the received blocking test signal the result of the verification of the user-data test signal is reproduced by the indicating devices 228, whereby an indication is given in addition that the system 201 is being operated in the test mode. For the purpose of indicating the test mode, an additional light-generating means, for example a yellow LED, can be used or the aforementioned light-generating means (red, green LED) can be operated in a way that differs from the operation in the course of verification of the user data that are provided via the contact-sensitive use interface 202 (e.g. flashing operation).

Since in the course of verification of the user-data test signal only user data pertaining to authorized users are taken as a basis, a successful verification in this case indicates a proper operating state of the system 201. Correspondingly it is possible to infer an error in the system 201 from a failed verification.

The embodiment of the system that is shown in FIG. 3 for the identification of a user comprises further components in addition to the components 204 to 234, which correspond to the components 202 to 234 of the system 201 shown in FIG. 2. Thus an output 236 is connected up via a connection 238 to a second contact-sensitive use interface 242 which is connected to the control device 214 via an input 240. The second contact-sensitive use interface 242 comprises, like the first contact-sensitive use interface 202, a sensor 244 with an electrically conductive surface, a capacitor 246 for the suppression of d.c. voltage and steady radiation and a trigger amplifier 248. The second contact-sensitive use interface 242 is operated, like the first use interface 202, for the purpose of activating the system 201 and for making user data available by means of a contact by a user.

Furthermore, a sensor device 252 is connected to the control device 214 via an input 250, and a radio unit 256 is connected to the control device 214 via an input 254. The sensor device 252 exhibits one or more sensors which, depending on the application of the system 201, may be optical (e.g. infrared-light-sensitive), acoustic (e.g. ultrasound-sensitive, speech-sensitive), temperature-sensitive, movement-sensitive, acceleration-sensitive sensors and proximity sensors.

The radio unit 256 serves to transmit data between the system 201 and external appliances (not shown), in order to supply to the control device 214 data that were mentioned in connection with the description of the user terminal 100 and the data interface 230. In addition, the radio unit 256 is connected to the output unit 220 via an output 258, in order to transmit signals generated by the control unit 214 to the external appliances which are not shown.

Moreover, the control device 214 is connected to a security device 262 via an output 260. The security device 262 is used in addition to the blocking function of the release device 224 in order to provide an additional protection against an undesirable use of devices and appliances that are operated in conjunction with the system 201 by unauthorized users. For this purpose the security device 262 may comprise, for example, (high-)voltage-generating components ("electroshockers"), access-preventing devices (e.g. grilles, covers), optical and/or acoustic signal generators (e.g. signal lamps, sirens) or combinations thereof.

The release device 224 is additionally connected to second indicating devices $\mathbf{264}_1, \ldots, \mathbf{264}_n$, which may be realized in a manner comparable to the indicating devices 228, whereby the indicating devices 228 and 264 which are used in the system 201 may be different. The indicating devices 264 serve to indicate the operating state and the operational capability of the release device 224. In order to be able to distinguish the information provided by the indicating devices 228 and 264 and to be able to assign them unequivocally, the indicating devices 228 and 264 should comprise indicating components which by virtue of their type (e.g. LEDs of different colors, optical vs. acoustic components . . . ), their operating mode (e.g. continuous signals vs. intermittent signals) and/or their spatial arrangement can be reliably distinguished and assigned. In this connection care is to be taken in particular when, in contrast to the embodiment represented in FIG. 3, the indicating devices 228 and 264 are integrated as a structural unit.

In addition to the operating states and functions described with reference to FIG. 2, the additional components of the system 201 allow further operating states and functions. Thus data/information, for example in the form of a software program or user data, can be transmitted via the radio unit 256 for the purpose of operation and for the purpose of control of the control device 214 in order, for example, to supply a remotely disposed system 201 or a system 201 that is operated in conjunction with portable devices and appliances with such data/information. In this way the use of the radio unit 256 enables, for example, a simple and rapid amendment of user data in the memory unit 218 or a control of the system 201 in which the system 201, in particular the release device 224, is deactivated or activated in order to release or to block the use of devices and appliances that are operated with the system 201 in respect of each user.

Furthermore, the radio unit 256 can be used in order to transmit output signals of the control device 214 with a view to processing by external appliances (not shown). In this way the operating states of the system 201 in response to user data that are provided via the contact-sensitive use interfaces 202 and 242 and the operational capability of the system 201 in the test mode can be recorded and evaluated. A verification of the operating and control data and information available in the system 201 and of user data stored in the memory unit 218 can also be performed in this way. Furthermore, the invention provides that the control device 214 transmits user data that are provided via one of the contact-sensitive use interfaces 202 and 242 via the radio unit 256, in order, for example, to record a current user and also to record the time/period and the frequency of use by a current user. Correspondingly it is possible to operate or to control the system 201 in desired manner (e.g. to activate it as described above) if, for example, the authorization to individual users or to several users is to be withdrawn for the time being and/or completely. The withdrawal of authorizations is required, for example, if predetermined periods of use and/or frequencies of use for individual or several users have been exceeded.

Environmental parameters for the system 201 (e.g. temperature, light, movement, vibration, moisture, noises, speech) and operating states of devices and appliances that can be released or blocked by the release device 224 can be recorded with the sensor device 252. Data/information recorded in this way can be recorded and stored for the purpose of pure data acquisition, but they can also be used for the operation of the system 201. Depending on the application of the system 201, it may be necessary to generate the release signal only in those cases when not only valid user data characterizing an authorized user are present but also other preconditions are satisfied. In the course of operating the system 201, the sensor device 252 can also be used in a test mode where desirable or undesirable environmental parameters are simulated.

The security device 262, which is activated by the blocking signal or for test purposes by the blocking test signal, supplements the blocking functions of the release device 224 which provides directly for the blocking of subordinate devices and appliances and should be designed accordingly. In order to prevent, in particular, a forcible, unauthorized use of devices and appliances that are operated with the system 201, or at least to deter against such use, mechanical devices that prevent a physical access by an unauthorized user, devices that attract attention in the vicinity of the system 201 and/or at remote locations, devices that, for example, deter an unauthorized user by emitting high voltages (electroshockers) or tear gas can be used by way of security devices 262.

In order that, prior to an actual use of devices and appliances that are operated with the system 201, an authorized user can check whether the system 201 is functioning properly, i.e. is identifying the user as an authorized user, and whether the user terminal 100 of said user is transmitting his user data correctly, the user contacts the sensor 244 of the second contact-sensitive use interface 242. As a result of this contact, as in the case of a contact of the first contact-sensitive use interface 202, the control device 214 is activated and supplied with the user data pertaining to the user terminal 100. After this, the control device 214 is operated in the test mode described above, whereby here the user-data test signal transmitted to the input unit 212 is obtained from the user data received via the second contact-sensitive use interface 242 and not from user data stored in the memory unit 218. The verification of this user-data test signal, the generation of the release test signal or of the blocking test signal and the indication of the result of verification are carried out as described above. A successful verification indicates that the system 201 and the user terminal 100 are operating correctly, whereas it is possible for a malfunction of the system 201 and/or of the user terminal 100 to be inferred from a failed test.

Also in the case of a data transmission via the first contact-sensitive use interface 201, a verification of the second contact-sensitive use interface 242 can be carried out in comparable manner via the connection 238. Furthermore, the invention provides for transmitting data pertaining to a user terminal 100 via the two contact-sensitive use interfaces 202 and 242 to another user terminal 100 for programming and/or updating of data. Authorization data that are required for this purpose are made available in the user terminals 100 concerned and in the control device 214.

The test mode of the system 201 may also further comprise a check of the release device 224. For this purpose it is necessary that the release device 224 responds to the release test signal and/or to the blocking test signal without thereby bringing about an actual release or blocking of subordinate devices and appliances. A suitable embodiment of the release device is described in more detailed manner in the following with reference to FIG. 4. The operational capability of the release device 224 is indicated as a function of the release and blocking test signals by means of the indicating devices 264.

In FIG. 4 an embodiment of the release device 224 is represented schematically which can be activated in the test mode for the purpose of functional testing without causing an actual release or blocking of subordinate devices and appliances. The release device 224 comprises between a supply voltage $U_b$ and an earth, connected in series, an electromagnetic actuator 266 and a transistor 268, the base contact of which is connected to the output 222 of the control device (not shown). Parallel to the electromagnetic actuator 266, a diode 270 is connected between the supply voltage $U_b$ and the output of the transistor 268 which is connected to the electromagnetic actuator 266. If the transistor 268, which may also be an optical coupler, receives the release test signal or the blocking test signal via the output 222, the electromagnetic actuator 266 is supplied with power in such a way that it is indeed activated (moved) in the sense of a release or a blocking of subordinate devices and appliances without thereby bringing about an actual release or blocking. This can be achieved, for example, by the release test signal and the blocking test signal being shorter than the release signal and the blocking signal, respectively, in order to limit temporally the supply of power to the electromagnetic actuator 266 for the purpose of functional testing in the test mode. After such an activation for test purposes the electromagnetic actuator 266 is deactivated, i.e. it moves back into its neutral position, as a result of which a flow of current through the diode 270 is generated by reason of the inductive effect in the actuator 266. In the case where use is made of an LED for the diode 270, the functional checking of the release device 224 can be indicated in a manner comparable to the indicating devices 264 (FIG. 3).

Figure 5:
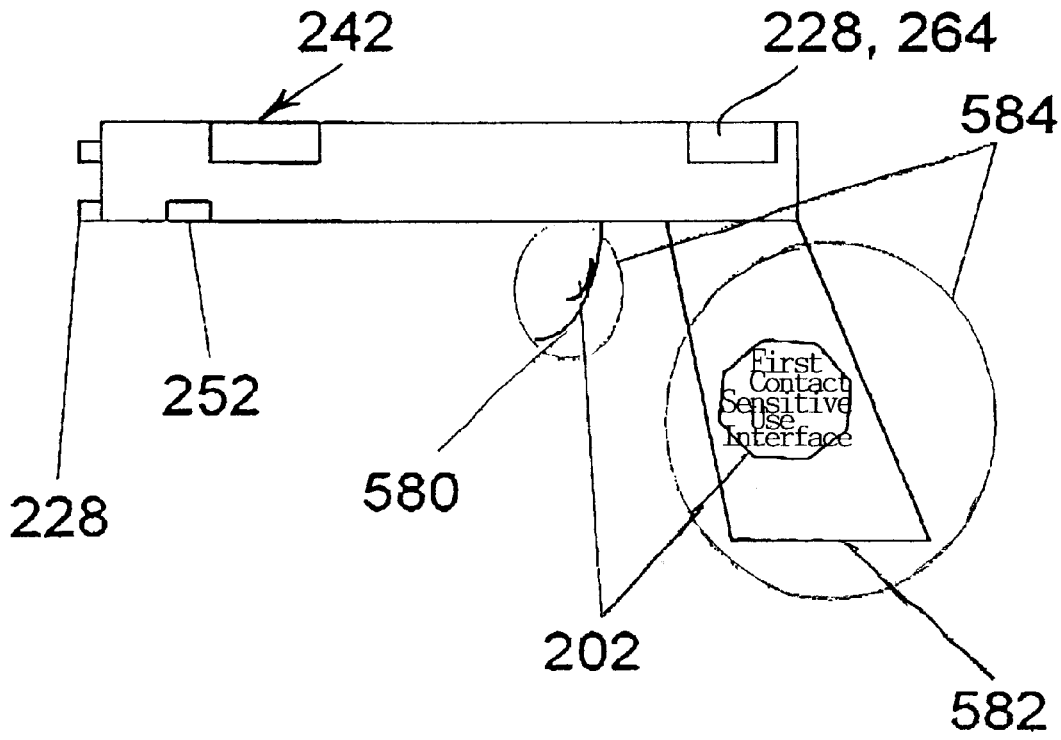
Figure 6:
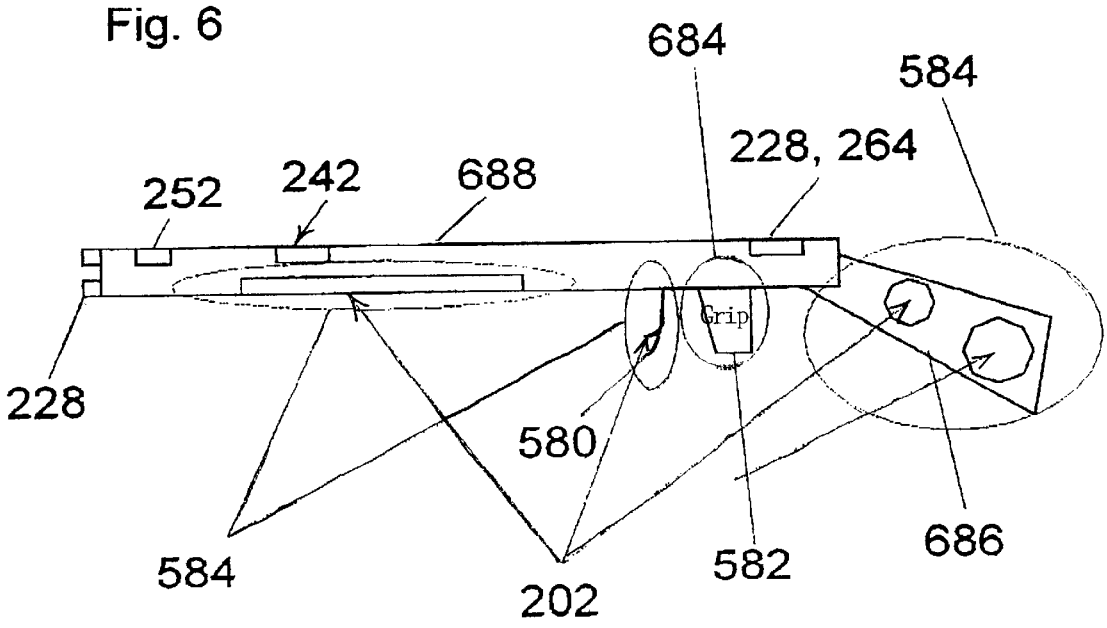

Referring to FIGS. 5 and 6, weapons (FIG. 5: pistol; FIG. 6: rifle) are described which are safeguarded by using the system 201 from FIG. 3. In FIGS. 5 and 6 only the components of the system 201, hereinafter called the weapon safeguarding system for short, are shown that are to be arranged on a weapon in contactable and/or perceptible manner.

The pistol that is shown schematically in FIG. 5 has a trigger 580 and a grip 582. In order to use the pistol, i.e. to fire a shot, the pistol is contacted in regions of the trigger 580 and of the grip 582. These regions are designated in the following as the contact region 584. In order to guarantee that a user of the pistol contacts the first contact-sensitive use interface 202, the latter is arranged within the contact region 584. In the case of the weapon that is shown in FIG. 5 the contact-sensitive surface of the first contact-sensitive use interface 202 is arranged in suitable regions of the trigger 580 and of the grip 582.

The second contact-sensitive use interface 242, which has to be contacted for the purpose of activating the test mode described above, is arranged outside the contact region 584, for example on the barrel of the pistol. The first and second indicating devices 228 and 264 are arranged within the field of view of the user using the pistol. Furthermore, in the case of the pistol that is represented in FIG. 5 the first indicating devices 228 are arranged redundantly in the muzzle region of the pistol, in order to indicate to the user whether the pistol is released or blocked if it is aimed at him.

In order to use the pistol, it is necessary for a user to carry the user terminal 100 so that the weapon safeguarding system receives the user data when the user takes the pistol in his hand. As soon as the user picks up the pistol, the weapon safeguarding system receives the user data and verifies whether the current user is an authorized user. In the case where this verification is concluded successfully, the pistol is released and the user is able to shoot with it. Depending on the data that are present in the weapon safeguarding system, the pistol can be released or blocked only for individual users or groups of users, for a predetermined number of uses (shots), for a predetermined length of time, within predetermined periods of time and also generally.

A general release or blocking of the pistol can be obtained by using suitable control data which are received via the radio unit 256. A general blocking of the pistol may, for example, be required if the pistol is located in an area in which no shot is permitted to be fired (e.g. outside a firing range) or if an unforeseen danger situation arises (e.g. persons within a lane of a firing range).

Furthermore, the release of the weapon may also presuppose that data indicating that the user has previously been successfully identified, e.g. by an identification system or by an inspector, are provided to the weapon safeguarding system. Such data can be transmitted via the radio unit 256 and/or via the user terminal 100 if the latter has been used for the previous identification. In this connection the procedure designated as "daisy-chaining" with reference to FIGS. 2 and 3 is utilized.

In order to record the number and the time of fired shots in straightforward manner, use is made of an acoustic sensor 252 (microphone) for the sensor device 252 which was described with reference to FIG. 3. In this way not only shots fired by the pistol represented in FIG. 5 but also shots fired in the vicinity by other weapons can be recorded and analyzed.

The pistol shown in FIG. 5 further comprises electrically conducting regions in the contact region 584. The electrically conducting regions, which are not designated in FIG. 5, serve as a security device with features of the security device 262 described with reference to FIG. 3. In response to a blocking signal generated by the weapon safeguarding system, voltages are emitted via the electrically conducting regions to an unauthorized user contacting the pistol in the contact region 584 in order to deter said unauthorized user from a further misuse of the pistol.

The rifle that is shown schematically in FIG. 6 differs from the pistol shown in FIG. 5 in that the contact region 684 of said rifle comprises suitable regions of a shoulder support 686 and of a barrel 688. Since the barrel 688 (with a hand) and the shoulder support 686 (with a cheek) are normally contacted at least partially with a view to firing a shot, regions of the contact-sensitive surface of the first contact-sensitive use interface 202 for receiving user data can also be arranged there.

With a view to deterring unauthorized users of the rifle, electrically conducting regions are also arranged in the contact region 684 that can emit voltages by using a power source (e.g. a battery) which is not shown.

What is claimed is:

1. A safeguarded weapon with controlled operation for preventing unauthorized use and/or accidental discharge of the weapon, comprising:

a discharge mechanism (580, 680) responsive to a release signal for enabling operation of the weapon when there is a release signal;

a first contact-sensitive use interface (202) for attaching to a contact region (584, 684) of weapon, said use interface for receiving user data characterizing a user contacting the weapon;

a control device coupled to the first contact-sensitive use interface and having an input unit (212) for receiving the user data, a second contact-sensitive interface (242) for receiving the user data from the user terminal (100), connected to the input unit (212) and located on the weapon and outside the contact region (584, 684);

a computer (216) for storing authorized user data and for verifying the user data received at the input, an output unit (220) for generating the release signal when the user data corresponds to an authorized user and generating a release test signal that is incapable of releasing the discharge mechanism (580, 680) in response to a successful verification of the user data received via the second contact-sensitive use interface (242).

2. The weapon of claim 1 wherein the output unit (220) generates a blocking signal for blocking the discharging mechanism (580, 680) of the weapon in the case of a failed verification of the user data.

3. The weapon of claim 1 further comprising a release device (224) for releasing the discharging mechanism (580, 680) in response to the release signal.

4. The weapon of claim 1 further comprising a body transmission device (118) that is capable of being connected to the user in electrically conducting manner for the purpose of transmitting the user data via the body of the user.

5. The weapon according to claim 1, wherein the output unit (220) generates a blocking test signal that is incapable of blocking the discharging mechanism (580, 680) in response to a failed verification of the user data received via the second contact-sensitive use interface (242).

6. The weapon according to claim 1 further comprising a second input (240) connected to the second contact-sensitive use interface (242) and to the first contact use interface (202); and the output unit (220) for transmitting the user data received via the second contact-sensitive use interface (242) whereby the computer unit (216) is adapted to receive and to verify the user data received from the second contact-sensitive use interface (242) via the first input (210).

7. The weapon according to claim 1, wherein the release device (224) further comprises means for testing the release device (224) without changing the operational state of the discharging mechanism (580, 680).

8. The weapon according to claim 1, wherein the release device (224) further comprises means for testing the blocking device without changing the operational state of the discharging mechanism (580, 680).

9. The weapon according to one claim 1 further comprising an indicating device (228, 264) for indicating results of the verification of the user data and/or for indicating the operating state of the weapon safeguarding system.

10. The weapon to claim 9, wherein the release device (224) comprises an electromagnetic actuator (266) and the indicating device (228, 264) comprises a diode (270) connected to the electromagnetic actuator (266).

11. The weapon according to claim 1 further comprising a radio unit (256) for receiving control data for the control device (214) and/or for transmitting data that reproduce the signals of the output unit (220) and/or the operating state of the weapon safeguarding system.

12. The weapon according to claim 11 further comprising a central controller for transmitting the control data and/or for receiving the data pertaining to the radio unit (256).

13. The weapon according to claim 1 wherein the contact region (584, 684) comprises at least one of the regions selected from the group consisting of regions of a trigger (580, 680), of a grip (582, 682), of a shoulder support (686) and/or of a barrel (688).

14. The weapon according to claim 1 further comprising a discharging mechanism including a trigger (580, 680), a firing pin, a mainspring, a breech head, a striking lever or a revolver cylinder.

15. The weapon according to claim 1 further comprising the release device (224) operationally linked mechanically to the discharging mechanism (580,680).

16. The weapon according to claim 1, wherein the contact region (584, 684) emits a voltage in response to the blocking signal.

* * * * *